US005413247A

United States Patent [19]

Glasa

[11] Patent Number: 5,413,247

[45] Date of Patent: May 9, 1995

[54] RELEASE ADAPTER FOR PRESSURE GAS CARTRIDGE

[75] Inventor: Stefan Glasa, Hamburg, Germany

[73] Assignee: Bernhardt Apparatebau GmbH u. Co., Germany

[21] Appl. No.: 219,202

[22] Filed: Mar. 29, 1994

[30] Foreign Application Priority Data

Feb. 5, 1994 [DE] Germany ..... 9401917 U

[51] Int. Cl.[6] ..... B67D 5/00

[52] U.S. Cl. ..... 222/5; 222/23; 222/83.5; 441/93

[58] Field of Search ..... 222/5, 23, 83.5; 441/92, 93, 94, 96, 101

[56] References Cited

U.S. PATENT DOCUMENTS

| | | | |
|---|---|---|---|
| 2,120,248 | 6/1938 | Hinchman | 222/5 |
| 3,015,414 | 1/1962 | Wilson | 222/5 |
| 3,145,573 | 8/1964 | Hebenstreit | 222/5 X |
| 3,266,669 | 8/1966 | Vuyosevich | 441/94 X |
| 3,298,571 | 1/1967 | Novak | 222/5 |
| 4,267,944 | 5/1981 | Mackal | 441/94 X |
| 4,416,393 | 11/1983 | Zimmerly | 222/5 |
| 5,311,394 | 5/1994 | Naab et al. | 441/93 X |
| 5,333,756 | 8/1994 | Glasa | 222/5 |

FOREIGN PATENT DOCUMENTS

| | | | |
|---|---|---|---|
| 1272060 | 7/1968 | Germany | 222/5 |

*Primary Examiner*—Andres Kashnikow
*Assistant Examiner*—Kenneth Bomberg
*Attorney, Agent, or Firm*—Kelly, Bauersfeld & Lowry

[57] ABSTRACT

An inflating device, more particularly for life jackets, includes a cartridge filled with pressure gas, which possesses a neck sealed with a diaphragm, and a cutter which, in the event of a release, penetrates with a sharp or pointed bottom portion the membrane on the cartridge. A releasing means, in the event of a release, acts upon the cutter with a force for penetrating the diaphragm. The diaphragm is distinguished by a simplified construction, which in particular permits the employment of a greatly simplified and very inexpensive cutter. It is proposed that the cutter be movably accommodated in a disposable part separated from the releasing means. The disposable part is rigidly connected with the cartridge and, together with the cartridge, can be detachably inserted into the releasing means.

10 Claims, 2 Drawing Sheets

RELEASE ADAPTER FOR PRESSURE GAS CARTRIDGE

The present invention relates to an inflating device, more particularly for life jackets, comprising a cartridge filled with pressure gas which possesses a neck sealed with a diaphragm, an opening cutter which, in the event of a release, pierces the diaphragm on the cartridge with a sharp or pointed base portion and a relating means which, in the event of a release, acts upon the cutter with a force for piercing the diaphragm.

BACKGROUND OF THE INVENTION

Automatic inflating devices are known which are comprised of a single base body into which a pressure gas bottle sealed with a diaphragm and constructed in the form of a cartridge is screwed. A spring element is located inside the device which, by the screwing in of the cartridge or by being fitted together, is tensioned and produces the requisite momentum force in order to, with the aid of a pertinent lever drive, subsequent to the interposition of a water-soluble tablet, drive a pointed cutter through the sealing diaphragm for the purpose of opening the pressure gas bottle.

In the known device, the actual opening means with the cutter and the releasing part equipped with the tablet are fixedly integrated into the base body. This means that the individual components together form a mechanical unit which, both in construction and manufacture, is comparatively expensive. This also applies in particular to the cutter which is integrated into the tensioning mechanism and has to be acted upon by a separate spring element in such a way that, when the mechanism is tensioned, the diaphragm is not inadvertently pierced by the introduction of the cartridge.

The technical problem of the invention is to provide a device of the type stated in the beginning which is distinguished by a simplified construction and which permits in particular the employment of a greatly simplified and very inexpensive cutter.

SUMMARY OF THE INVENTION

Provision is made in this case for the cutter to be movably accommodated in a disposable part which is separated from the releasing means, said disposable part being rigidly connected to the cartridge and can be detachably inserted into the releasing means together with the cartridge.

The essence of the invention consists in removing the cutter from the actual releasing means and to accommodate the same separately in a disposable part which is rigidly connected with the cartridge and supplied along with the latter. In this way, when constructing the cutter, no need exists of showing any consideration for the remaining mechanism of the releasing means, whereby substantial simplifications are possible.

In a preferred further development of the device according to the invention, in the disposable part, an optical indicating means is additionally accommodated which indicates whether the cutter has been actuated for opening the cartridge. Also with regard to the indicating means it is not necessary to take the remaining mechanism of the releasing means into consideration so that it is possible to put into effect the same advantages of a simple construction for the indicating means.

A first preferred embodiment of the indicating means is distinguished in that it comprises a forcibly separable small indicator plate which is visibly externally and is thrust outwardly by means of an ejection or forcible separation element acted upon by the cutter when the cutter is moved in the opening direction. It is possible to hereby realize a quite simple but effective and operationally reliable indicating means which reveals immediately and at any time whether a release has taken place or not.

A second preferred embodiment of the indicating means is characterized in that the cutter is displaceably guided in a cutter guideway, through which cutter guideway the gas escaping from the cartridge flows when the releasing means is actuated in that the forcible separation element is displaceably guided in a bore which communicates with the cutter guideway, and in that the part of the forcible separation element directed to the cutter guideway is constructed in the form of a piston so that, in the event of a gas escape from the cartridge, the forcible separation element is thrust into the cutter guideway against the small indicator plate without any previous actuation of the cutter due to the gas pressure. With this embodiment it is also possible, without any further additional auxiliary means apart from the normal release, to optically indicate a possible, otherwise caused leakage of the cartridge so that it is also easy to check the readiness for use of the apparatus.

BRIEF DESCRIPTION OF THE DRAWINGS

In the following the invention is explained in greater detail in connection with the drawings with the aid of embodiment examples. Thus

DETAILED DESCRIPTION OF THE PREFERRED EMBODIMENT

Figure 1B:
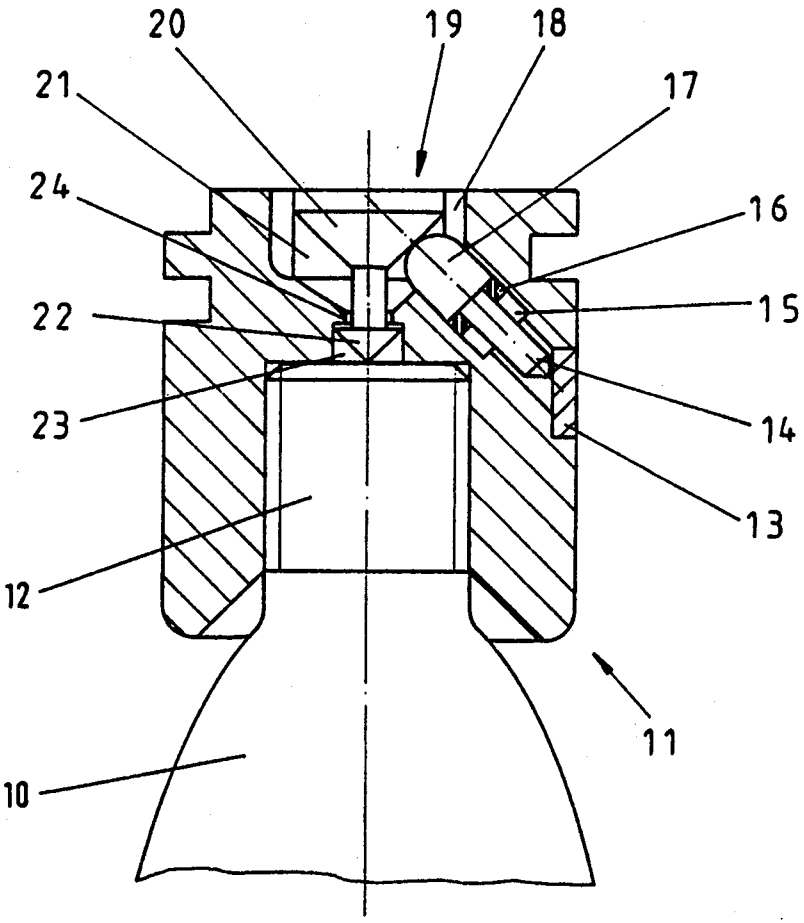
FIG. 1*a* and 1*b* show, in a partial section, two very largely identical embodiment examples of a disposable part with cutter and indicating means according to the invention with a securing of the cutter by means of a tight fit (FIG. 1*a*) and by an undercut on the cutter guideway (FIG. 1*b*)
Figure 1A:
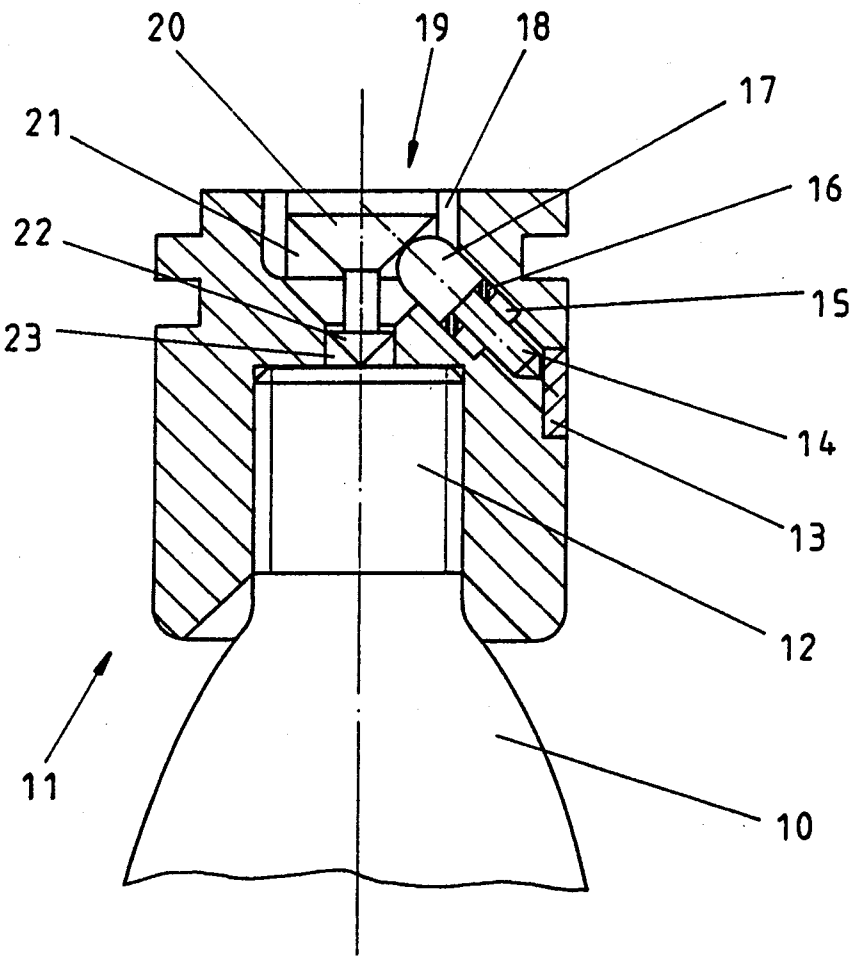
Figure 2:
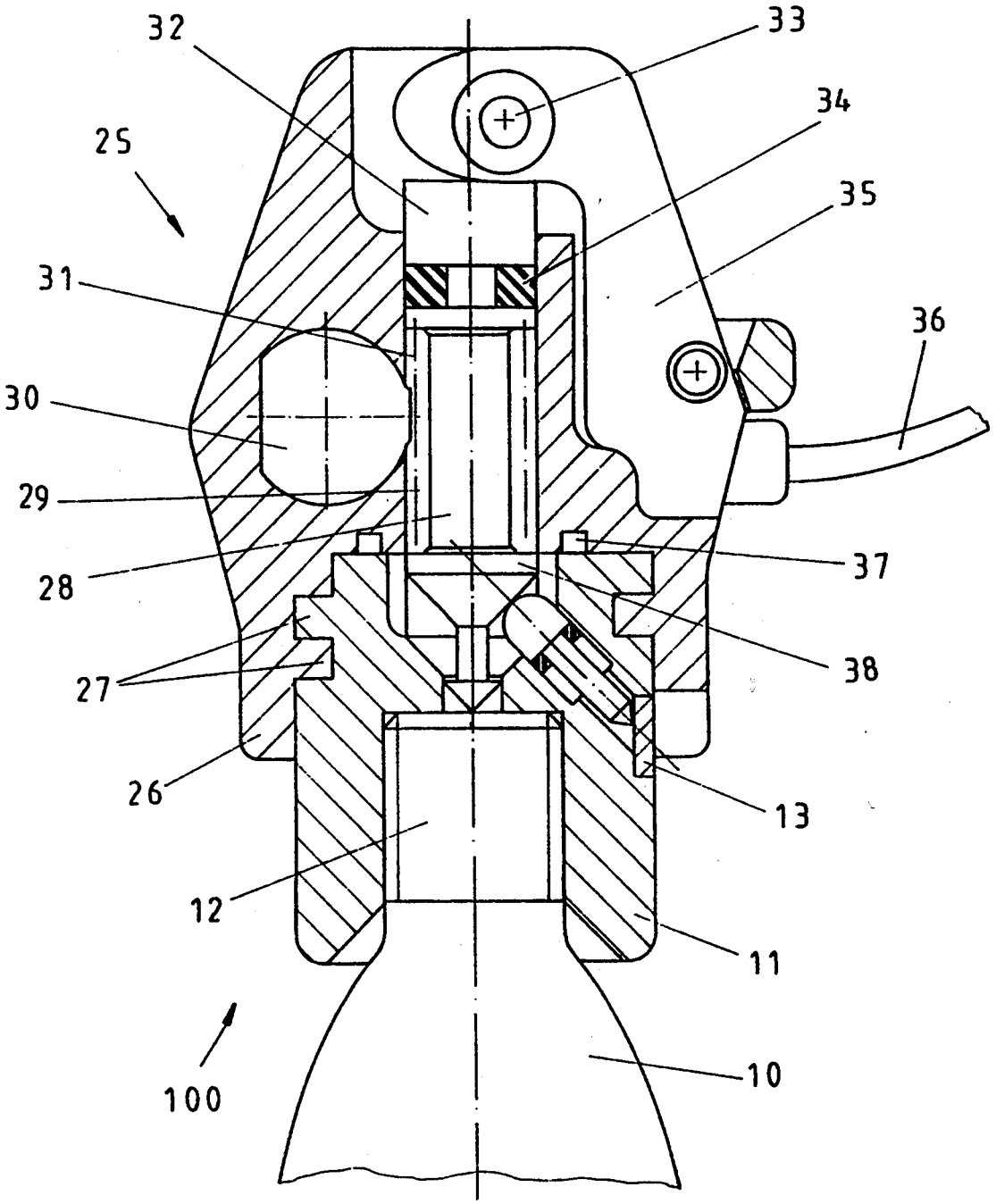
FIG. 2 shows, in a partial section, the cartridge equipped with a disposable part according to FIG. 1*a* after its insertion into a releasing means shown by way of example.

In the FIG. 1, in a partial section, two very largely identical embodiment examples of a disposable part having a cutter and an indicating means according to the invention which differ solely in the way in which the cutter is secured. The disposable part 11, in the lower region, possesses a tapped bore, into which the cartridge 10 containing pressure gas, onto which a neck 12 possessing a corresponding external thread is formed, can be firmly screwed on. Thus cartridge 10 and disposable part 11 constitute a ready-for-sale unit which can then (as depicted in the example of the FIG. 2) be inserted into a releasing means 25 which, together with the same, forms the inflating device 100.

The disposable part 11 is screwed onto the neck 12 of the cartridge 10 like a cap. Starting out from the tapped bore for the cartridge 10, a through bore Leads concentrically to the center axis up to the top side of the disposable part. The through bore comprises, in the form of sections, two cutter guideways 21 and 23, of which the latter is disposed underneath the first and possesses a smaller diameter than the first. A cutter 19 is guided in the cutter guideways 21,23, said cutter being preferably composed of two conical sections disposed on top of each other and, with its point, is directed toward the cartridge 10, said conical, sections being interconnected with the aid of a cylindrical center portion possessing a smaller diameter. The larger one of the conical sections is guided in the upper cutter guideway 21, the smaller section in the lower cutter guideway 23. The smaller section forms at the same time the point of the cutter 19 which, during the releasing operation, pierces the diaphragm on the neck 12 of the cartridge 10.

When, during the releasing operation, the cutter 19 is thrust downwardly and penetrates the diaphragm with its point, the cylindrical center portion of the cutter comes to be located in the lower cutter guideway 23. Since the center portion possesses a relatively small diameter, the pressure gas from the opened cartridge 10 is able to flow almost unimpededly through the bottom cutter guideway 23. Since, in this position, the upper cutter guideway 21 would continue to be blocked by the larger conical section of the cutter, provision has been made laterally for overflow ducts 18, through which the pressure gas is able to flow around the conical part.

The upper conical section of the cutter 19 serves at the same time as actuating element of an optical indicating means which is preferably likewise accommodated in the disposable part 11. The optical indicating means comprises a small indicator plate 13 which can be forcibly separated and which is fitted into a recess or indentation sunk into the outside of the disposable part and which can be e.g. set off by means of coloring from the remaining disposable part. From the recess for the small indicator plate 13 up to the cutter guideway 21,23, a bore 15 proceeds obliquely upwardly, in which a substantially cylindrical forcibly separable element 14 is displaceably guided. The forcibly separable element 14 is constructed in such a way that, in the operative state, it terminates with its lower end close to or direct on the inside of the small indicator plate 13 and rests with its top rounded-off end on the casing surface of the upper conical cutter section. If, during the releasing operation, the cutter 19 is thrust vertically downward, the cutter presses at the same time the forcibly separable element 14 in the bore 15 obliquely downward where it forcibly ejects the small indicator plate 13 from its seating in the recess. In this manner it is easily discernible from the outside by the missing small indicator plate 13 that the cutter 19 has in actual fact been actuated in a releasing operation.

Besides this indication function, the indicating means preferably also additionally assumes a further indicating function. For this the forcibly separable element 14 is, at its upper end, constructed in the form of a piston 17 which is fitted into the bore 15 and sealed by means of a seal 16. If now, for any reasons whatsoever, pressure gas flows from the cartridge 10 into the cutter guideway 21, 23 without the cutter 19 having been actuated, i.e. thrust downward, the excess pressure prevailing in the cutter guideway 21, 23 pushes the piston 17 and, with it, the forcably separable element 14 in the bore 15 obliquely downward so that, in this fashion, the small indicator plate 13 is likewise forcibly ejected. That is why a forcibly ejected small indicator plate 13 indicates that either a regular release has taken place or that the cartridge 10 has become evacuated due to other reasons (leakage or such like). In both cases the inflating device is no longer ready for use and has to be brought into an operative state once more.

The small indicator plate 13 may be adhesively affixed to or jammed into the recess. The forcibly separable element 14 may be disposed so as to be displaceable (as in FIG. 1) or swivelable. The cutter 19, which is supported so as to be readily displaceable in the cutter guideway 21,23, can be secured against a dropping out or an inadvertent release. In the embodiment example of the FIG. 1*a* this is done by such a tight fit being selected in the cutter guideway 21,23, that a sufficiently strong friction is produced. In the embodiment example of the FIG. 1*b* this is done in that, by way of example, on the lower cutter guideway 23, an undercut 24 is provided which the cutter 19 grips from behind with its Lower conical section. The cartridge 10 firmly screwed together with the disposable part 11 is supplied in the form of a complete detachable accessory and can, as per FIG. 2, be inserted into a releasing means 25 prepared therefor and, for example, be retained by means of a bayonet catch 27. Inside the releasing means 25, above the cutter 19, inside a plunger bore 29, a releasing plunger 28 is displaceably disposed which is supported upon the top side of the cutter with its lower plunger disc 38. But the plunger bore 29 communicates at half height laterally with a gas connection piece 30, though which, in the event of a release, the gas is able to flow in to the container to be inflated. On the upper end, the releasing plunger 28 passes into a plunger head 32 which is fitted into the bore 29 and sealed with an inserted annular seal 34. Underneath the plunger head 32, a spring 31 may be mounted in the plunger bore 29 which acts upon the release plunger with an upwardly directed force. On the top side of the plunger head 32, an actuating lever 35 is acting which is swivellably supported in a rotary axis, which can be swivelled with the aid of known releasing or triggering means, such as e.g. a water-soluble tablet or a hand release brought about by means of an actuating cord 36. If the actuating lever is swivelled, its upper end urges the releasing plunger 28 downward which, for its part, thrusts the cutter 19 through the diaphragm. With this, also the small indicator plate is forcibly ejected which is readily discernible on account of a recess in the casing of the releasing means. In order to prevent the gas then flowing out from escaping laterally at the connect ion point between disposable part 11 and releasing means 25, this connection point is preferably surrounded by a sealing groove 37 into which a seal can be inserted.

All in all, with the invention an inflating device results, in which, in a particularly simple manner, a cutter and, if required, an optical indicating means, can be integrated in the form of a disposable element into a disposable part and rigidly connected with the cartridge into a supply unit, be inserted into a releasing means or automatic releasing means of a conventional type.

What is claimed is:

1. An inflating device comprising a cartridge filled with a pressure gas and which possesses a neck sealed with a diaphragm, a cutter which, in the event of a release, pierces with a sharp bottom portion the diaphragm on the cartridge, and a releasing means which, in the event of a release, acts upon the cutter with a force for piercing the diaphragm, characterized in that:

the cutter is movably accommodated in a disposable part separated from the releasing means, said disposable part being rigidly connected with the cartridge and which can, together with the cartridge, be detachably inserted into the releasing means; and in the disposable part an optical indicating means is additionally accommodated which indicates whether the cutter has been actuated for opening the cartridge.

2. The inflating device according to claim 1, characterized in that the indicating means comprises an externally visible, forcibly separable, small indicator plate which, by means of a forcible separation element, is thrust outwardly when the cutter moves in the opening direction.

3. The inflating device according to claim 2, characterized in that the cutter in the disposable part is displaceably guided in a cutter guideway, through which cutter guideway, in the event of a release, the gas escaping from the cartridge flows, in that the forcible separation element is displaceably guided in a bore which communicates with the cutter guideway, and in that the part of the forcible separation element directed toward the cutter guideway is constructed in the form of a piston in such a way that, in the event of gas escaping from the cartridge into the cutter guideway without any previous actuation of the cutter having taken place, the forcible separation element is thrust against the small indicator plate by the gas pressure.

4. The inflating device according to claim 3, characterized in that the cartridge, on its neck, is provided with an external thread and, with the external thread, is screwed onto a corresponding tapped bore in the disposable part.

5. The inflating device according to claim 4, characterized in that, for the detachable connection between the disposable part and the releasing means, a bayonet means and a bayonet catch is provided.

6. The inflating device according to claim 3, characterized in that, for the detachable connection between the disposable part and the releasing means, a bayonet means and a bayonet catch is provided.

7. The inflating device according to claim 2, characterized in that the cartridge, on its neck, is provided with an external thread and, with the external thread, is screwed onto a corresponding tapped bore in the disposable part.

8. Inflating device according to claim 2, characterized in that, for the detachable connection between the disposable part and the releasing means, a bayonet means and a bayonet catch is provided.

9. The inflating device according to claim 1, characterized in that the cartridge, on its neck, is provided with an external thread and, with the external thread, is screwed onto a corresponding tapped bore in the disposable part.

10. The inflating device according to claim 1, characterized in that, for the detachable connection between the disposable part and the releasing means a bayonet means and a bayonet catch is provided.

* * * * *